US006360751B1

(12) United States Patent
Fagg et al.

(10) Patent No.: US 6,360,751 B1
(45) Date of Patent: Mar. 26, 2002

(54) ASYMMETRICAL TRIMMER DISK APPARATUS

(75) Inventors: Barry Smith Fagg; Mickey Lee Smith, both of Winston-Salem; John Larkin Nelson, Lewisville; Travis Eugene Howard, Clemmons, all of NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/452,413

(22) Filed: Dec. 1, 1999

(51) Int. Cl.[7] ..... A24C 5/18
(52) U.S. Cl. ..... 131/84.4; 131/83.1
(58) Field of Search ..... 131/84.4, 83.1

(56) References Cited

U.S. PATENT DOCUMENTS 4,210,159 A * 7/1980 Quarenghi ..... 131/21 D
4,485,826 A * 12/1984 Holzangel ..... 131/84 C
5,526,826 A 6/1996 Heitmann
5,813,412 A * 9/1998 Okumoto ..... 131/84.4

* cited by examiner

*Primary Examiner*—Stanley G. Silverman
*Assistant Examiner*—Mark Halpern

(57) ABSTRACT

An asymmetrical trimmer disk/paddle wheel apparatus for trimming tobacco from a stream or braid of cut tobacco in a cigarette maker comprises a pair of counter rotating disks with a plurality of pockets arranged to coact with one another to trim off excess tobacco and create densified regions at the filter and lit ends of a cigarette rod product made in the maker. The pockets are constructed with different widths and depths to provide densified regions of different densities and lengths at the filter and lit ends of the cigarette rod product. The cigarette rod product formed by the asymmetrical trimmer disk/paddle wheel apparatus has an improved density profile that minimizes rejects at maker speeds up to about 8000 rods/minute.

13 Claims, 3 Drawing Sheets

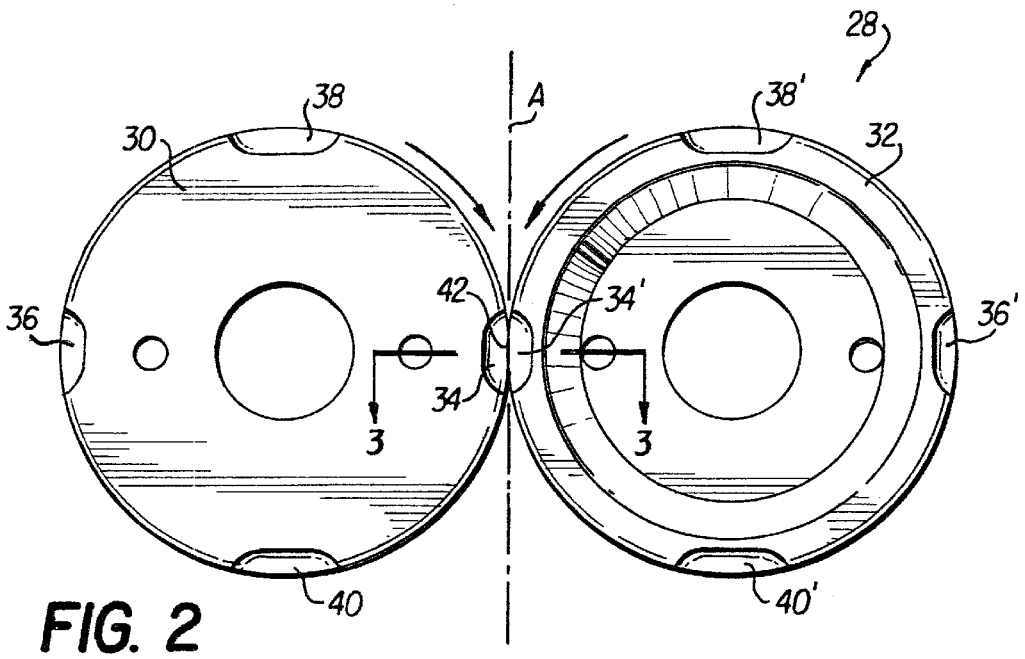
FIG. 2
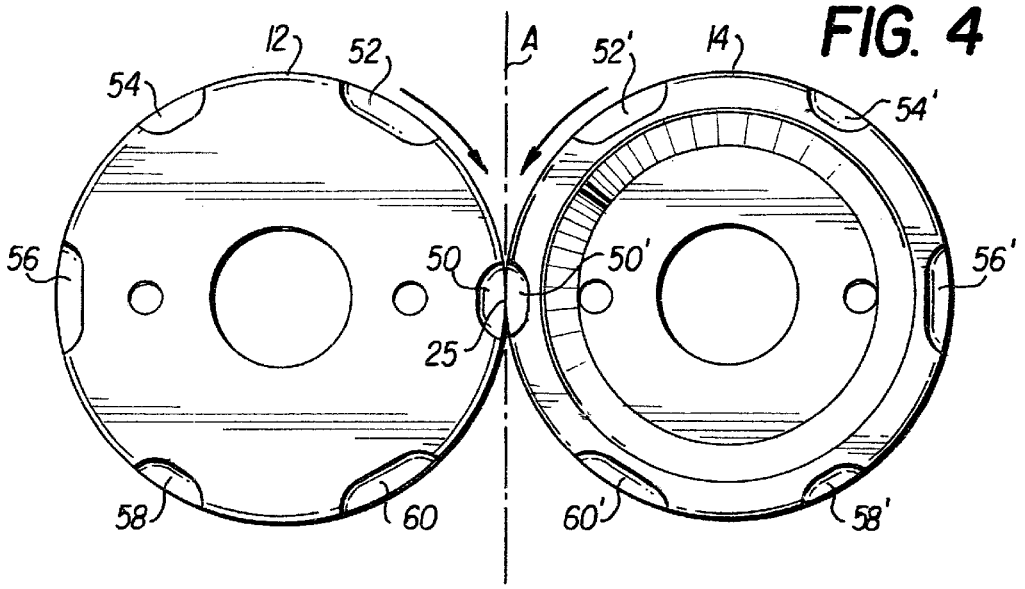
FIG. 4
FIG. 3
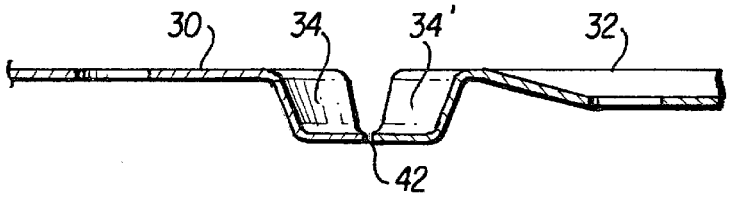

ASYMMETRICAL TRIMMER DISK APPARATUS

BACKGROUND OF THE INVENTION

1. Field of the Invention

The present invention relates to cigarette making apparatus and a cigarette rod product and more particularly to a tobacco trimming apparatus for removing the surplus tobacco from a continuous stream or rod of cut tobacco on a cigarette maker and the cigarette rod product of such apparatus.

2. Description of the Prior Art

Modern cigarette makers utilize a trimmer disk/paddle wheel assembly in the formation of a rod or braid of cut tobacco that is subsequently formed into a cigarette rod. In the cigarette maker, a braid or bed of cut tobacco is continuously formed against a foraminous vacuum belt and the trimmer disk/paddle wheel assembly shears off portions of the tobacco braid or bed into a final continuous, elongated tobacco shape or profile. The tobacco is then wrapped in cigarette paper to form a continuous cigarette rod that is subsequently cut into appropriate lengths for making individual cigarettes. One example of such a cigarette maker is manufactured by Hauni Maschinenbau AG of Hamburg, Germany.

Typically, the trimmer disks of such cigarette makers have pockets or recesses formed in the periphery of the disks for the purpose of increasing the volume of cut tobacco at given intervals or spacing along the braid of tobacco. Because the final cigarette rod diameter is substantially constant along its length, the increase of tobacco volume at given intervals creates a more dense tobacco rod at those intervals. By cutting the rod at the areas of greater tobacco rod density or packing density, the tobacco rod at both the lit end and the filter end of a cigarette is of greater density than the density of the tobacco rod intermediate the cigarette ends. The greater rod density at the lit end reduces tobacco fallout at that end during processing and packaging of the cigarettes and the greater rod density at the filter end provides sufficient structure or body for attachment of a filter to the tobacco rod. The densification of the tobacco rod at the ends of the rod allow cigarette manufacturers to reduce the total weight of tobacco in a cigarette yet maintain an acceptable product quality as well as an acceptable reject rate in the cigarette maker.

In one example of a conventional trimmer disk, the pockets or recesses in the disk have a radial depth of about 3.0 mm and a circumferential width of about 22.0 mm with four or six pockets symmetrically spaced around the disk periphery. Since each pocket width spans two lit ends or two filter ends, this configuration theoretically provides a dense region of about 11.0 mm at each end of the cut tobacco rod. The number of pockets on the trimmer disk periphery is a function of the diameter of the disk and the length of the cigarette being manufactured, as well as the rotational speed of the disk and the longitudinal velocity of the tobacco braid.

It is known to provide a tobacco braid with alternating regions of different densities, i.e., so as to provide a cigarette rod having a greater density at the lit end and a lesser density at the filter end. U.S. Pat. No. 4,210,159 discloses a trimmer disk/paddle wheel assembly in which alternating pockets on the trimmer disk are formed with different depths so as to provide a greater cross-sectional area of tobacco at alternating pockets and thus a greater density of the tobacco rod at the location of the pocket with the greater depth. The widths of all the pockets are the same so that the lengths of the dense regions at each end of the rod are the same.

U.S. Pat. No. 5,526,826 discloses an alternative arrangement for densifying longitudinally spaced regions along a tobacco braid. In the arrangement of this patent, a compacting unit disposed upstream of a trimmer disk assembly comprises a rotating wheel with a plurality of equiangularly spaced peripheral lobes which compact longitudinally spaced apart regions of an advancing tobacco stream to densify the tobacco stream in those regions. Insofar as taught by U.S. Pat. No. 5,526,826, each of the densified regions of the tobacco braid formed by the lobed wheel is uniform both in density and length.

It has been discovered that one problem associated with the conventional trimmer disk/paddle wheel assembly as disclosed in the aforementioned U.S. Pat. No. 4,210,159 is that as the speed of the cigarette maker is increased from about 2000 rods/minute up to about 8000 rods/minute, the densification of the end regions gradually deteriorates resulting in reduced cut end quality and an increased rejection rate. Increasing the rod density at the cut end regions for a given weight of tobacco in a cigarette can improve end region quality at higher maker speeds, but is likely to result in a "softer" or less dense middle or intermediate region between the cigarette ends and creates the risks of rod breakage during manufacture and fire cone falloff during smoking.

It would therefore be desirable to provide a cigarette making apparatus that is capable of operating at speeds of up to about 8000 rods/minute to make a cigarette rod with no substantial deterioration of the end regions and a sufficiently dense intermediate region to avoid the problems of rod breakage during manufacture and fire cone falloff during smoking.

SUMMARY OF THE INVENTION

In view of the foregoing limitations and shortcomings of the prior art apparatus and cigarette rod product, as well as other disadvantages not specifically mentioned above, it should be apparent that there still exist a need in the art for a trimmer disk/paddle wheel assembly that provides the proper density distribution along the tobacco braid so that the cigarette maker can be operated at substantially higher speeds than is presently possible, i.e., up to 8000 rods/minute, with little or no sacrifice of quality at either end region or the intermediate region of the cigarette rod and no increase in tobacco weight in the cigarette. There is also a continuing need in the art to optimize the density profile of the tobacco blend with respect to rod formation dynamics at the higher cigarette maker speeds. There also exists a need for a cigarette rod product that has a unique density profile that makes it possible to increase the speed of the cigarette maker up to 8000 rods/minute with little or no increase in rejection rate of the product compared to the rejection rate at lower maker speeds.

According to both its apparatus and product aspects, the present invention fulfills that need by the use of an asymmetrical trimmer disk in a trimmer disk/paddle wheel assembly in which the pockets or recesses of the disk have different widths especially designed to provide an optimum density profile for a cigarette rod of a given tobacco weight. It is also contemplated according to the present invention that other asymmetrical configurations of the pocket widths may be used depending on the tobacco blend, cigarette rod length and weight of tobacco in the rod.

The asymmetrical trimmer disk of the present invention is provided with a plurality of pockets or recesses on its periphery in equiangularly spaced relation having alternating different circumferential or arcuate extent or width, that is, the width of every other recess is the same and the widths of adjacent recesses are different. This asymmetrical arrangement of the pockets or recesses advantageously provides a cigarette rod with a unique density profile with a longer, more dense region at the lit end of the cigarette rod and, at the filter end of the cigarette rod, a densified region that is shorter and less dense than the densified region at the lit end and an acceptable intermediate region between the densified end regions. In one non-limiting example of an asymmetrical trimmer disk according to the present invention, a four pocket trimmer disk for a 68 mm tobacco rod has two oppositely disposed first pockets with a depth of 4.0 mm and a width of 22 mm for forming the lit end of the rod and two oppositely disposed second pockets spaced 90 degrees from the first pockets with a depth of 3.0 mm and a width of 16 mm for forming the filter end of the rod. Pockets of the same dimensions may be used in a six pocket trimmer disk (three each of the first and second pockets above) to make 57 mm tobacco rods. Of course, other widths and depths of the asymmetrical trimmer disk may be used within the scope of the invention for other tobacco blends, cigarette rod lengths and weight of tobacco in the rod.

It has been found that operating cigarette makers using asymmetrical trimmer disks with the aforementioned pocket dimensions has resulted in significant improvement in loose ends of the tobacco rod and loose end rejects at higher maker operating speeds from 2000 rods/minute up to about 8000 rods/minute.

The cigarette rod product of the present invention has a density profile with a densified region at the lit end having a first density and a longitudinal length of about 11 mm and a densified region at the filter end having a second density less than the first density and a longitudinal length of about 8 mm.

With the foregoing and other advantages and features of the invention that will become hereinafter apparent, the nature of the invention may be more clearly understood by reference to the following detailed description of the invention, the appended claims and the views illustrated in the drawings.

BRIEF DESCRIPTION OF THE DRAWINGS

FIG. 2 is a top plan view of a pair of four pocket asymmetrical trimmer disks according to the present invention;

FIG. 3 is a fragmentary cross-sectional detail view of a pocket of the asymmetrical trimmer disk of FIG. 2 taken along line 3—3 of FIG. 2;

FIG. 4 is a top plan view of a pair of six pocket asymmetrical trimmer disks according to the present invention;

DETAILED DESCRIPTION OF THE INVENTION

Figure 1:
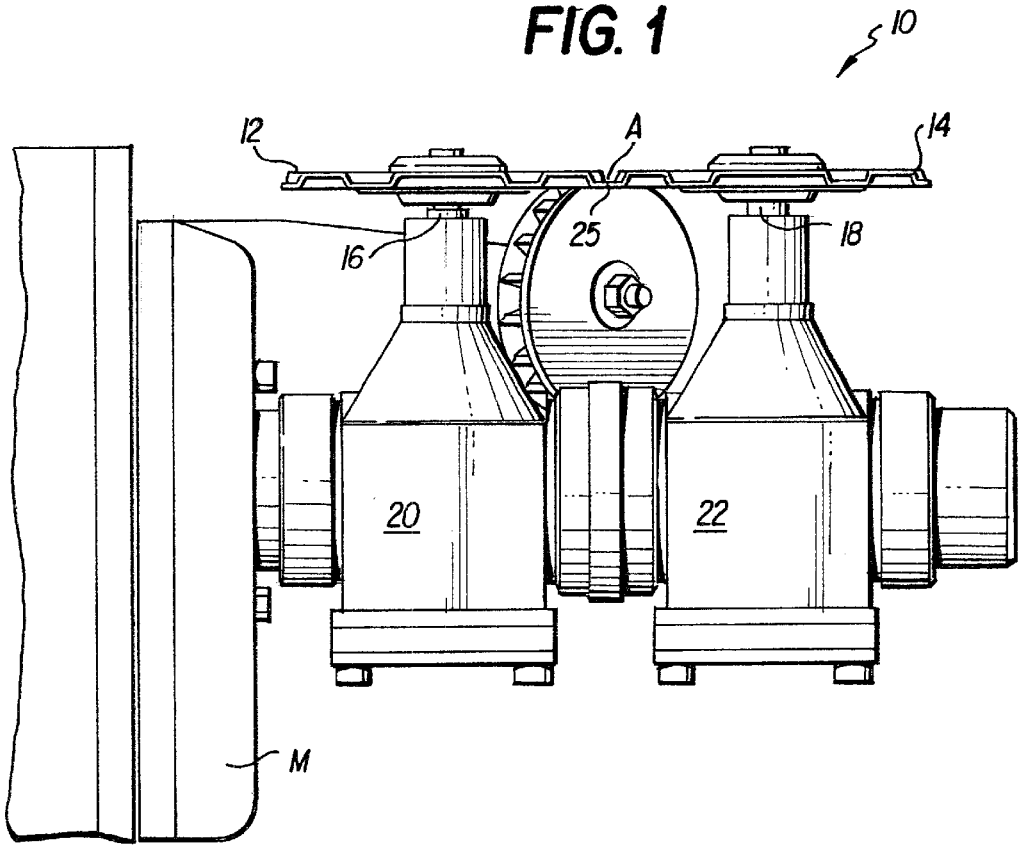
FIG. 1 is a side elevation view of the asymmetrical six pocket trimmer disk/paddle wheel assembly apparatus of the present invention shown in connection with a typical cigarette maker of the type manufactured by Hauni Maschinenbau AG of Hamburg, Germany.

Referring now in detail to the drawings, FIG. 1 illustrates one preferred embodiment of the asymmetrical trimmer disk/paddle wheel assembly apparatus 10 of the invention similar to that disclosed in the aforementioned U.S. Pat. No. 4,210,159, the entire disclosure of which is incorporated herein by reference. In the embodiment of FIG. 1, the apparatus 10 comprises a pair of substantially coplanar, counter rotating disks 12, 14 of identical construction each having four or six peripheral pockets and being mounted for rotation in a common horizontal plane. The disks 12, 14 are mounted to the upper ends of vertical shafts 16, 18 which are rotated in opposite directions by means of conventional gear drive means 20, 22 connected to a drive motor M. The rotary disks 12, 14 are tangential and substantially contiguous (e.g., 0.1 mm gap) at the periphery of the disks to form a nip 25 at which the tobacco is trimmed off at a point below the feed axis A of the tobacco stream or braid.

The under side surfaces of the disks 12, 14 define the lowermost trimmed surface of the tobacco braid or stream except for the pocket regions in which the tobacco stream is trimmed off at the nip formed between the pockets and thus extends below the upper plane of the disks as described in more detail hereinafter. A paddle wheel 24 is rotatably mounted beneath the rotary disks 12, 14 on a horizontal axis arranged at an angle to the feed axis A of the tobacco braid and is also driven in a known manner by the drive motor M. The drive means 20, 22 for the rotary disks 12, 14 and the drive mechanism for the paddle wheel 24 are not specifically illustrated and described herein since they are well known and conventional and a description of their operation is not necessary for an understanding of the present invention.

FIGS. 2 and 3 illustrate one embodiment of the asymmetrical trimmer disk apparatus 28 of the present invention. In this embodiment, the trimmer disks 30, 32 are provided with four pockets or recesses 34–40 and 34'–40', respectively, equiangularly spaced 90 degrees apart around the periphery of the disks. The pockets 34, 34' are shown in confronting tangential relationship with the nip 42 between the disks located a given depth, e.g., 3 mm, below the upper surfaces of the disks 30, 32 (FIG. 3). As the disks 30, 32 rotate in opposite directions as shown by the arrows in FIG. 2, successive pockets 38, 38', 36, 36' and 40, 40' come into tangential confronting relation and trim off the tobacco braid a few millimeters below the nip formed between the upper surfaces of the disks. It will be understood by those skilled in the art that the trimming off of the underside of the tobacco stream or braid with the trimmer disks 30, 32 as the braid advances along the braid axis A will result in spaced regions along the tobacco braid where the volume of tobacco is greater by an amount approximating the volume of the pocket pairs 34, 34', 38, 38', 36, 36' and 40,40'.

In the four pocket trimmer disk embodiment of FIGS. 2 and 3, the disks 30, 32 have asymmetrical pockets in both depth and width. For example, the pockets 34, 34' and 36, 36' have a depth of 3 mm and a width of 16 mm for forming a densified region at the filter end of a tobacco rod and the pockets 38, 38' and 40, 40' have a depth of 4 mm and a width of 22 mm for forming a densified region at the lit end of a tobacco rod. This four pocket asymmetrical trimmer disk can be used to make cigarette rods of about 68–90 mm length depending on the diameter of the disk.

FIG. 4 illustrates the six pocket asymmetrical trimmer disk apparatus of FIG. 1 wherein the disks 12, 14 each are provided with six pockets 50–60 and 50'–60', respectively, equiangularly spaced at 60 degree intervals around the periphery of each disk. In this embodiment, the pockets 50, 50' are shown in confronting tangential relationship with the nip 25 between the disks located a given depth, e.g., 3 mm, below the upper surfaces of the disks 12, 14. As the disks 12, 14 rotate in opposite directions as shown by the arrows in FIG. 4, successive pockets 52, 52', 54, 54', 56, 56', 58, 58' and 60, 60' come into tangential confronting relation and trim off the tobacco braid a few millimeters below the nip formed between the upper surfaces of the disks. As noted above, it will be understood by those skilled in the art that the trimming of the tobacco stream with the trimmer disks as the stream advances along the stream axis A will result in spaced regions along the tobacco stream where the volume of tobacco is greater by an amount approximating the volume of the pocket pairs 50, 50'–60, 60'.

In the six pocket trimmer disk embodiment of FIGS. 1 and 4, the disks 12, 14 have asymmetrical pockets in both depth and width. The pockets 50, 50', 54, 54' and 58, 58' have a depth of 3 mm and a width of 16 mm for forming a densified region at the filter end of a tobacco rod and the pockets 52, 52', 56, 56' and 60, 60' have a depth of 4 mm and a width of 22 mm for forming a densified region at the lit end of a tobacco rod. This six pocket asymmetrical trimmer disk can be used to make cigarette rods of about 50–67 mm length depending on the diameter of the disk.

Figure 5:
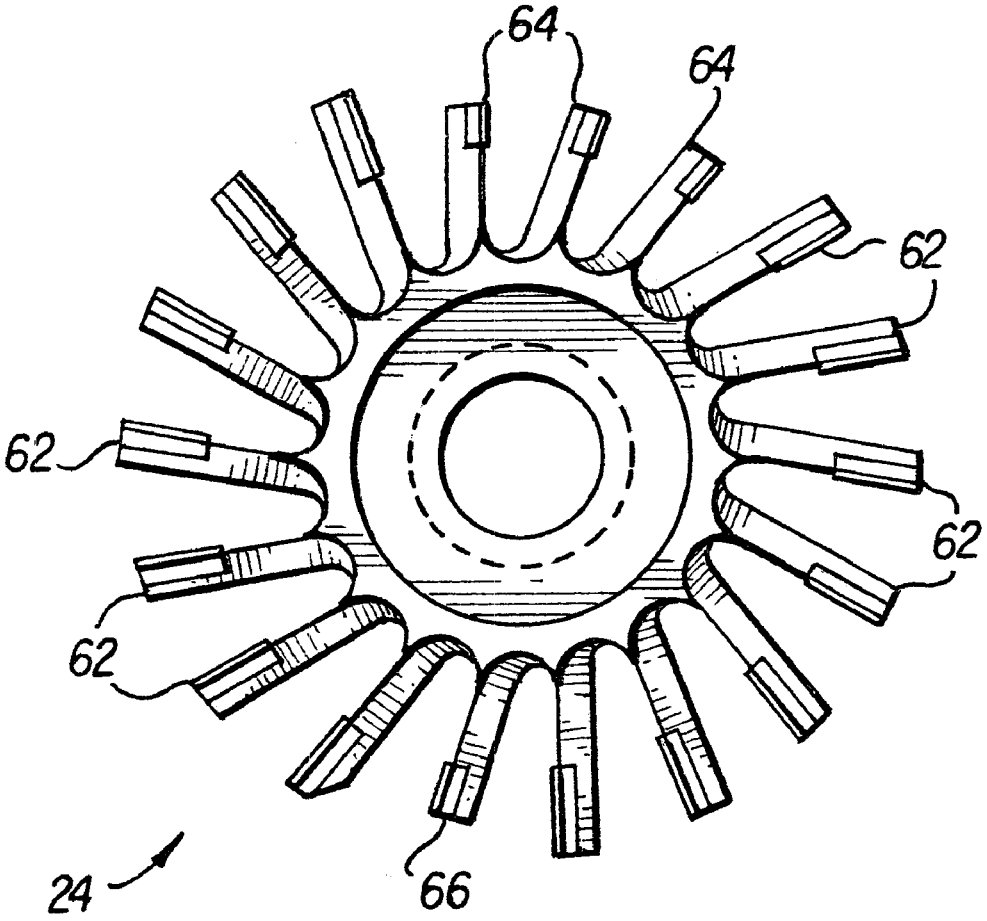
FIG. 5 is a side elevation view of a paddle wheel suitable for use with either the four or six pocket asymmetrical trimmer disk of the present invention.

FIG. 5 shows the paddle wheel 24 used with both the four and six pocket trimmer disks of the invention. The paddle wheel 24 has a plurality of blades or paddles 62 that are used in a conventional manner to remove a portion of the surplus tobacco from the stream with minimal comminution of the cut tobacco particles. The paddle wheel 24 is arranged at an oblique angle to the direction of movement of the tobacco stream so that the separated particles of tobacco are propelled to one side of the tobacco stream. Three of the paddles 64 are radially shortened on one side of the paddle wheel and another paddle 66 is shortened on the other side of the paddle wheel. The three shortened paddles 64 correspond to the greater depth of the pockets 38, 38' and 40, 40' of the four pocket disks 30, 32 and the pockets 52, 52', 56, 56' and 60, 60' of the six pocket disks 12, 14 and the one shortened paddle 66 corresponds to the lesser depth of the pockets 34, 34' and 36, 36' of the four pocket disks 30, 32 and the pockets 50, 50', 54, 54' and 58, 58' of the six pocket disks 12, 14. As is well known, the rotation of the paddle wheel 24 is synchronized with that of the disks 12, 14 and 30, 32 in such a way that the shortened paddles 64 cooperate with the pockets of greater depth and width and the shortened paddle 66 cooperates with the pockets of lesser depth and width.

Figure 6:
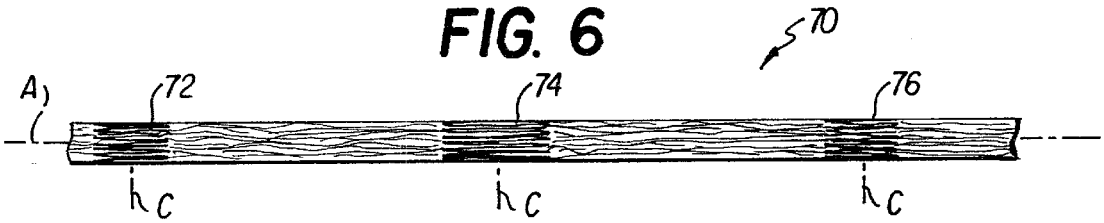
FIG. 6 is a longitudinal cross-sectional view of a portion of a tobacco braid formed with the asymmetrical trimmer disk/paddle wheel assembly apparatus of the present invention graphically showing the locations where the densified end regions of the tobacco braid are cut.

Referring now to FIG. 6, there is graphically depicted in longitudinal cross-section a section of the tobacco braid 70 made using the asymmetrical trimmer disk apparatus of the present invention. Braid 70 has longitudinally spaced densified regions 72, 74, 76 which correspond, for example, to the pockets 34, 34', 38, 38' and 36, 36', respectively, of the four pocket trimmer disks 30, 32 or the pockets 50, 50', 52, 52' and 54, 54' of the six pocket trimmer disks 12, 14. Because of the greater depth of the pockets 38, 38' and 52, 52' the density of the densified region 74 is greater than that of the densified regions 72, 76. The longitudinal extent or length of the densified region 74 is also greater than that of the densified regions 72, 76. In the above example of pockets of 22 mm width and 16 mm width, the length of the densified regions 72 and 76 is about 16 mm and the length of the densified region 74 is about 22 mm. The dash-dot lines C illustrate the midpoints of the densified regions 72, 74, 76 where the tobacco braid would be transversely cut in subsequent processing after it has been wrapped in cigarette paper to form a continuous cigarette rod.

Figure 7:
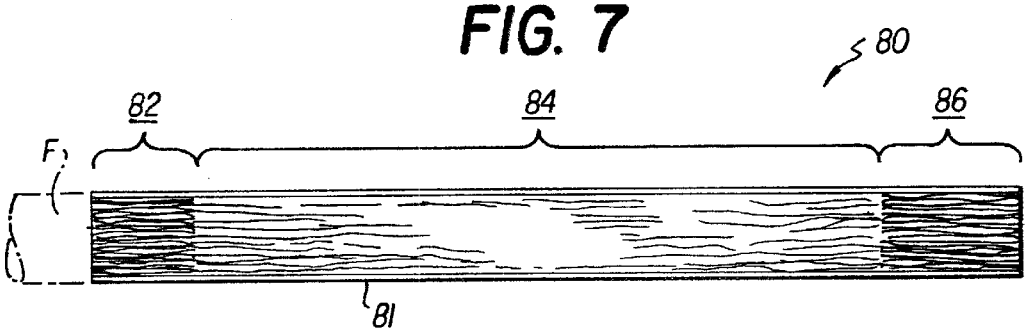
FIG. 7 is a longitudinal cross-sectional view of a cigarette rod product made with the asymmetrical trimmer disk of the present invention graphically showing the densified end regions of the cigarette rod product.

FIG. 7 illustrates a cigarette rod product 80 with a filter F that is manufactured from the tobacco braid shown in FIG. 6. The cigarette rod product 80 is wrapped in conventional cigarette paper 81 and has a densified filter end portion 82, an intermediate portion 84 and a densified lit end portion 86. The density of the lit end portion 86 is greater than the density of either the intermediate portion or the filter end portion and the density of the filter end portion is greater than the density of the intermediate portion. Using the asymmetrical trimmer disks described above with pocket widths of 16 mm and 22 mm, the longitudinal length of the densified region 82 is about 8 mm and the longitudinal length of the densified region 86 is about 11 mm. The density of the tobacco rod in the intermediate region 84 is sufficient to avoid "soft" middle rejects and to prevent fire cone falloff even at cigarette maker speeds up to 8000 rods/minute.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. Apparatus for trimming excess tobacco extending from a continuous tobacco stream moving along its longitudinal axis comprising a pair of substantially coplanar, counter rotating disks mounted adjacent the longitudinal axis of the tobacco braid, means for counter rotating said disks, said disks being disposed tangent to one another to form a nip between the disks, said disks being arranged to trim away the excess tobacco at the nip between the disks, each disk having at least two peripheral pockets, the peripheral pockets of one disk being arranged to coact with a corresponding peripheral pocket of the other disk, a first pair of pockets having a first depth in a direction perpendicular to a plane parallel to the disks and a first width in a circumferential direction parallel to the plane of the disks, a second pair of pockets having a second depth in a direction perpendicular to the plane of the disks and a second width in a circumferential direction parallel to the plane of the disks, the first width of the first pair of pockets being greater than the second width of the second pair of pockets.

2. The apparatus of claim 1, wherein the first depth of the first pair of pockets is greater than the second depth of the second pair of pockets.

3. The apparatus of claim 1, wherein each disk has a periphery and four pockets equiangularly spaced around the periphery of each disk.

4. The apparatus of claim 1, wherein each disk has a periphery and six pockets equiangularly spaced around the periphery of each disk.

5. The apparatus of claim 1, wherein the width of said first pair of pockets is about 22 mm and the width of the second pair of pockets is about 16 mm.

6. The apparatus of claim 5, wherein the depth of the first pair of pockets is about 4 mm and the depth of the second pair of pockets is about 3 mm.

7. The apparatus of claim 3, wherein the pockets of the first and second pairs of pockets alternate around the periphery of the disks.

8. The apparatus of claim 4, wherein the pockets of the first and second pairs of pockets alternate around the periphery of the disks.

9. The apparatus of claim 1, including a rotatable paddle wheel disposed beneath the disks for rotation about an axis at right angles to the rotational axes of the disks, means for rotating the paddle wheel, said paddle wheel having a first plurality of radial paddles of a given radial length, one radial paddle having a shortened radial length less than said given radial length of the first plurality of radial paddles and a second plurality of radial paddles having a radial length less than the shortened radial length of the one radial paddle.

10. The apparatus of claim 9, wherein said second plurality of paddles consists of three radial paddles having the same radial length.

11. In a cigarette making machine, a pair of coacting trimmer disks each having a periphery and being arranged to tangentially contact one another in a common plane to form a nip for cutting off excess tobacco from a tobacco stream suspended above the trimmer disks and traveling along a longitudinal path of travel, means for counter rotating the disks in opposite directions about a respective rotational axis of the disks, each disk having a plurality of pockets spaced around the periphery of each disk, each pocket of one disk cooperating and coacting with a respective pocket of the other disk as the disks are counter rotated, the adjacent pockets of each disk having different circumferential lengths along the path of travel of the tobacco stream and different depths in a direction perpendicular to the common plane of the disks.

12. The apparatus of claim 11, wherein the pockets of a first set of coacting pockets of the disks have circumferential lengths and depths greater than the circumferential lengths and depths of the pockets of a second set of coacting pockets of the disks.

13. The apparatus of claim 12, including a rotatable paddle wheel disposed beneath the disks for rotation about an axis at right angles to the rotational axes of the disks, means for rotating the paddle wheel, said paddle wheel having a first plurality of radial paddles of a given radial length, one radial paddle having a shortened radial length less than said given radial length of the first plurality of radial paddles and a second plurality of radial paddles having a radial length less than the shortened radial length of the one radial paddle.

* * * * *